United States Patent [19]

Stefanovic

[11] 4,292,708

[45] Oct. 6, 1981

[54] HINGES WITH POSITION-LOCKING FILAMENTS

[75] Inventor: Miroslav Stefanovic, Willowbrook, Ill.

[73] Assignee: Stocker Hinge Mfg. Co., Brookfield, Ill.

[21] Appl. No.: 82,638

[22] Filed: Oct. 9, 1979

[51] Int. Cl.[3] ..... E05D 11/08; E05D 5/10

[52] U.S. Cl. ..... 16/140; 16/168

[58] Field of Search ..... 16/140, 168, 169

[56] References Cited

U.S. PATENT DOCUMENTS 3,397,422 8/1968 Youngdale ..... 16/168 X

FOREIGN PATENT DOCUMENTS 1584211 1/1970 Fed. Rep. of Germany ..... 16/168

364246 1/1932 United Kingdom ..... 16/140

*Primary Examiner*—James Kee Chi

*Attorney, Agent, or Firm*—Keil & Witherspoon

[57] ABSTRACT

Hinges having two or more hinge leaves mounted for relative pivotal movement with or about a hinge pin by substantially cylindrical knuckles on the leaves, and a piece of filamentary material positioned inside the knuckles alongside the pin and frictionally holding the hinge leaves in an open position.

2 Claims, 4 Drawing Figures

HINGES WITH POSITION-LOCKING FILAMENTS

BACKGROUND

The subject invention pertains to improvements in hinges, by which the hinge leaves can be manufactured in and/or pivoted into an open position and releasably held in this position during finishing operations such as electroplating or coating or assembly operations wherein the hinges are mounted on articles in which the hinge is used.

It is desirable, when finishing hinges, that the hinge be in an open position for a uniform plating or coating of both sides of the hinge leaves and their knuckles. Further, in some manufacturing operations where the hinges are mounted on articles being manufactured, it is desirable or helpful for the manual handling or for automatic machine feeding of hinges to have all hinges in the same, open position.

PRIOR ART

No prior art is known which discloses, or suggests to persons of ordinary skill in the art, the use of a filamentary body within the knuckles forming the hinge's pivot about the hinge pin to hold the hinge in a particular position, e.g., the above-discussed open positions.

One prior technique for releasably locking the hinge in an open position was the punching at the juncture between two adjacent knuckles on opposite hinge leaves, with the hinge in open position, to create a small, round embossment extending across the juncture. The punched segments of the two knuckles were deformed enough to hold the hinge leaves and their knuckles in one or more open positions. Such technique, however, did not consistently produce the open-position, releasable interlocking of the knuckles, due to variations of thickness of the flat steel stock from which the hinge leaves and their knuckles were manufactured, occasional misalignments of the punch with the juncture of two knuckles, and the like.

STATEMENT OF THE INVENTION

The invention herein resides in improvements in hinges wherein two hinge leaves are pivotable relative to each other between a closed position wherein the two leaves are substantially parallel and generally in overlying relationship to open positions wherein the leaves are at acute, right and/or obtuse angles to each other or are coplanar (a 180° angle). Each leaf has one or more knuckles disposed along one edge thereof at spaced intervals. In most cases, the knuckles of one leaf fit into the space (s) next to or between knuckles of the other leaf. When aligned, the knuckles of the two leaves form a substantially cylindrical passage in which the hinge pin is seated.

The improvements provided by the subject invention reside in laying within the passage and along the cylindrical side of the pin a piece of filamentary material, e.g., a yarn, a thread, a monofile, a bundle (two or more) of said yarn, thread or monofile, and other filamentary bodies having a transverse cross-section which is round, oval, square, oblong (as in a narrow band or strip), wire, a wire cable, and the like. The chief requirement of the size and shape of the transverse cross-section is that it have a thickness sufficient to provide a frictional fit with the inner walls of the rotatable knuckles and the hinge pin sufficient to hold the hinge in an open position.

The open position is desired when finishing the hinges. Also, the invention offers the advantage of keeping all hinges in a desired open position during manual handling and/or feed of hinges by automated machinery during assembly of parts to be hingedly connected.

THE PREFERRED EMBODIMENTS

Preferred embodiments of the invention are illustrated in the drawings, wherein:

Figure 1:
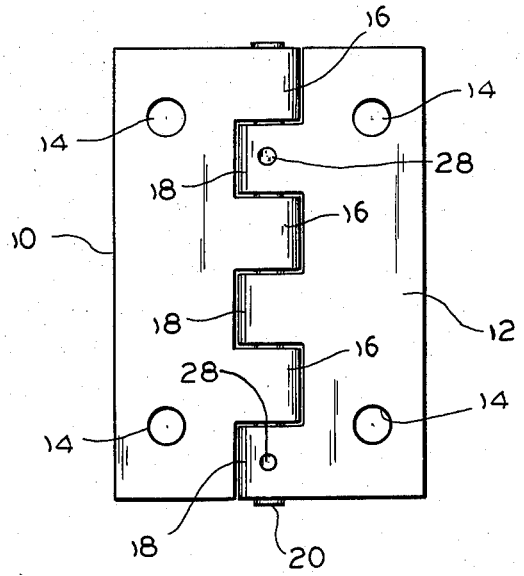
FIG. 1 is a plan view of the bottom of a first hinge.

Referring to the drawings, the hinges comprise a first rectangular hinge leaf 10 and a second rectangular hinge leaf 12, each leaf having a pair of mounting screw holes 14. The leaf 10 has along one edge thereof three spaced knuckles 16, while the leaf 12 has along one edge thereof three spaced knuckles 18 which interfit between and adjacent to the knuckles 16. The leaves are manufactured with substantially cylindrical knuckles having a substantially cylindrical passage. When the leaves are assembled, the passages are aligned to form a composite, substantially cylindrical passage 24 in which is seated the hinge pin 20. One set of knuckles may be made fixed relative to the pin 20 by staking, e.g., by providing in one or more knuckles of one leaf punched embossments 28 of sufficient depth to seat the raised surfaces thereof on the opposite side of the embossment tightly against or into the pin. This keeps the pin from falling out of the knuckles. In the illustrated embodiments, the staking embossments are in two knuckles 18 in FIG. 1 of leaf 12. The knuckles 16 of the other leaf are rotatably mounted on the pin.

Figure 2:
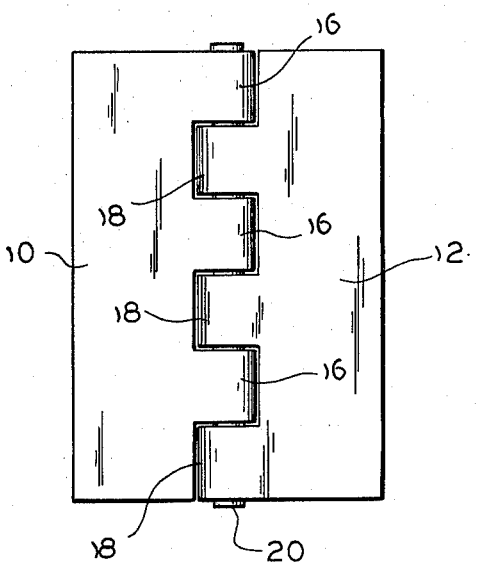
FIG. 2 is a plan view of the bottom of another hinge.

The embodiment of FIG. 2 is substantially the same as that of FIG. 1 with two exceptions— the leaves 10, 12 have no mounting screw holes 14 and there is no embossment 28 to stake either leaf to the hinge pin. The hinge is attached to the article on which it is used by welding, adhesive, in situ molding, etc. In the hinge of FIG. 2, the filamentary material 26 may have a sufficiently tight fit to releasably hold the leaves in an open position and also keep the hinge pin from falling out of the knuckles. If desired, however, other means to hold the pin 20 in the substantially cylindrical passage 24 may be used, e.g., by peening over one or both ends of the pin, by a head on one end of the pin, etc.

Figure 3:
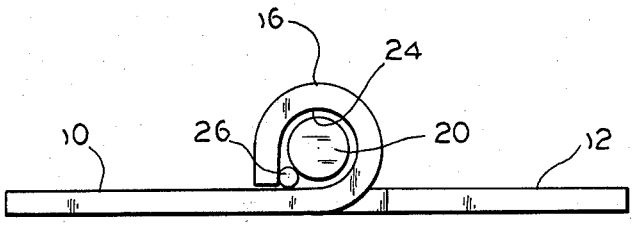
FIG. 3 is an end view of the hinges of FIGS. 1 and 2.
Figure 4:
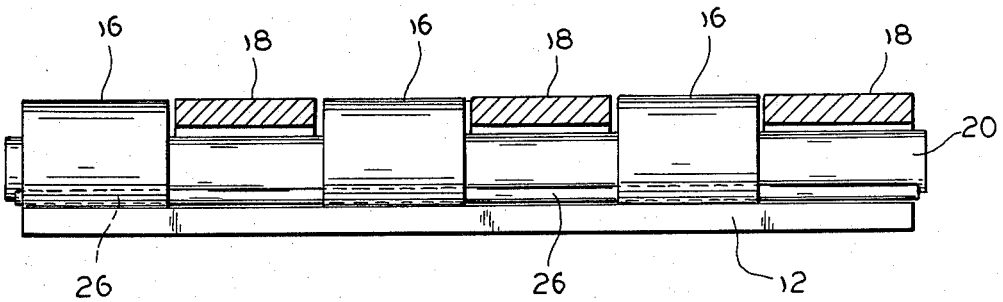
FIG. 4 is a side elevation, partially in fragment, of the hinges of FIGS. 1 and 2.

As can be seen in FIGS. 3 and 4, a piece of filamentary material 26 lies longitudinally along the side of the pin 20. This piece of filamentary material has a thickness sufficient to provide a frictional fit with the inner walls of the knuckles, i.e., the knuckles 16 in FIG. 1 and the knuckles 16, 18 in FIG. 2. The fit is such that it is capable of releasably holding the hinge in an open position, i.e. a position in which the leaves are coplanar and in other positions such as acute obtuse and/or right angular disposition of the leaves. In transverse cross-section, the filamentary material may be round, oval, square, oblong or the like.

The best mode for making the subject hinges is to form the knuckles 16,18 about the hinge pin 20 and the piece of filamentary material 26 laid beside the pin. Another mode is that of making the knuckles before the pin is inserted therein, followed by assembly of the leaves with their respective sets of knuckles aligned to form the passage 24, followed by inserting the piece of filamentary material 26 in the passage, and thereafter or simultaneously inserting the pin in the passage while keeping the filamentary piece 26 in position in the passage or feeding some alongside the pin being inserted.

The filamentary material 26 may be a metal wire, a small wire cable, a synthetic plastic polymer monofile filament or narrow strip, a textile yarn or thread, a bundle of monofile filaments and the like. It may be wear-resistant or wear-prone. In the latter case, the position-holding function would be important only during treatment of the hinge, e.g., electroplating or coating and/or during placing the hinge in the assembly of the article being manufactured.

I claim:

1. In a hinge comprising two hinge leaves, respectively, having knuckles, the inner walls of which form, when aligned, a substantially cylindrical passage in which a full-cylindrical hinge pin is seated, the knuckles of at least one of said leaves being rotatable about said hinge pin, the improvement comprising a piece of filamentary material laid along the hinge pin within said passage and being of a length, and having a thickness, sufficient to provide a frictional fit between the pin and the inner walls of at least one each of the relatively rotatable knuckles of said two hinge leaves, which frictional fit is capable to releasably hold said hinge in an open position.

2. A hinge as claimed in claim 1, and including means staking at least one knuckle of one of said leaves to said hinge pin, the knuckles of the other leaf being rotatably mounted on said hinge pin.

* * * * *